US010086624B2

(12) United States Patent
Yoon

(10) Patent No.: US 10,086,624 B2
(45) Date of Patent: Oct. 2, 2018

(54) PHOTO PRINTER

(71) Applicant: DS GLOBAL, Seoul (KR)

(72) Inventor: Hee Pil Yoon, Seoul (KR)

(73) Assignee: DS GLOBAL, Seoul (KR)

( * ) Notice: Subject to any disclaimer, the term of this patent is extended or adjusted under 35 U.S.C. 154(b) by 0 days.

(21) Appl. No.: 15/652,758

(22) Filed: Jul. 18, 2017

(65) Prior Publication Data

US 2018/0022111 A1 Jan. 25, 2018

(30) Foreign Application Priority Data

Jul. 21, 2016 (KR) ..... 10-2016-0092928
Sep. 12, 2016 (KR) ..... 10-2016-0116966

(51) Int. Cl.

| | |
|---|---|
| ***B41J 2/32*** | (2006.01) |
| ***B41J 2/335*** | (2006.01) |
| ***B41J 11/04*** | (2006.01) |
| ***B41J 2/525*** | (2006.01) |
| ***B41J 25/00*** | (2006.01) |

(52) U.S. Cl.

CPC ..... *B41J 2/33505* (2013.01); *B41J 2/32* (2013.01); *B41J 2/525* (2013.01); *B41J 11/04* (2013.01); *B41J 25/006* (2013.01)

(58) Field of Classification Search

CPC ..... B41J 15/04; B41J 15/042; B41J 15/044; B41J 15/0475; B41J 25/304; B41J 25/308; B41J 25/3088; B41J 25/3086; B41J 25/3084; B41J 25/3082; B41J 25/34; B41J 25/316; B41J 25/312; B41J 2/335

See application file for complete search history.

(56) References Cited

U.S. PATENT DOCUMENTS

2008/0272534 A1* 11/2008 Shimizu ..... B65H 1/266 271/10.12
2012/0242772 A1* 9/2012 Jimbo ..... B41J 11/0025 347/197

* cited by examiner

*Primary Examiner* — Kristal Feggins
(74) *Attorney, Agent, or Firm* — Cantor Colburn LLP

(57) ABSTRACT

Provided is a photo printer including: a base adapted to accommodate paper therein; a pickup roller protruding from the bottom of the base to feed the paper accommodated in the base forwardly; a platen roller disposed in front of the base to discharge the paper fed by the pickup roller forwardly; a head located above the platen roller to apply given heat to the paper; a swing bracket having a mounting portion formed at the front side thereof in such a manner as to be coupled to the head and coupling portions formed at the rear side thereof in such a manner as to be rotatably coupled to the base to allow the head to swing; and pressurizing means adapted to pressurize the head downwardly to allow the head to come into close contact with the paper advancing into the space between the head and the platen roller.

6 Claims, 10 Drawing Sheets

PHOTO PRINTER

BACKGROUND OF THE INVENTION

Field of the Invention

The present invention relates to a photo printer, and more particularly, to a photo printer that is configured to allow the heat applied from a head to be transferred to a local portion of paper and further to allow the head to be pressurized under a uniform pressure over the entire area thereof toward a platen roller, thereby improving a print quality thereof.

Background of the Related Art

Recently, a photo printer has been introduced so that pictures on smartphones can be instantly printed whenever and wherever.

There are various kinds of photo printers, but among them, particularly, a photo printer is introduced wherein printing paper to which a zero-ink printing technology is adopted is used, thereby requiring no ink or cartridge to reduce the maintenance cost thereof. In case of such zero-ink printing technology, the part corresponding to the cartridge is contained in the paper, and accordingly, only heat is used to express colors. That is, dyes, which respond to heat and thus express colors, are laminated on the paper, so that the heating temperature or heating time of a head is controlled to print images (pictures) or texts.

FIG. 1 is a sectional view showing a conventional photo printer. As shown, the conventional photo printer 1 includes a base 15 on which paper sheets P are stacked, a pickup roller 40 disposed protruding from the underside of the base 15, a platen roller 30 for discharging the paper P fed by the pickup roller 40 forwardly, a thermal printing head 12*a* disposed above the platen roller 30 to apply heat to the paper P, and a PCB 13 for controlling the heating temperature and heating time of the head 12*a*. Further, the head 12*a* and the PCB 13 are located on the underside of a heating plate 12, and the heating plate 12 is coupled to an upper casing 10, while the platen roller 30 is being coupled to a lower casing 20.

Referring to FIG. 2, the lower casing 20 is coupled to the upper casing 10 in front of the platen roller 30 by means of hinge shafts 11. If the paper P is fed between the platen roller 30 and the head 12*a*, as a result, the lower casing 20 swings downwardly (to the position of the lower casing 20') around the hinge shafts 11. Further, the rear sides of the upper casing 10 and the lower casing 20 are connected to each other by means of springs S, so that the upper casing 10 and the lower casing 20 can swing elastically.

(a) and (b) of FIG. 3 are sectional views showing the use states of the conventional photo printer. As shown in (a) of FIG. 3, a given space is formed between the head 12*a* and the platen roller 30 in such a manner as to be smaller than the thickness of the paper P. On the other hand, the PCB 13 has a solder joint 13*a* and a device 13*b* mounted thereon. So as to prevent the paper P from being locked onto the solder joint 13*a* and the device 13*b* when the paper P enters, the PCB 13 is inclined upwardly toward the rear side thereof. Accordingly, the thickness of the photo printer becomes large.

In this state, if the paper P advances into the space between the head 12*a* and the platen roller 30 by means of the pickup roller 40, the lower casing 20 swings around the hinge shafts 11 located at the front side thereof so that the rear side of the lower casing 20 moves downwardly.

Through the above-mentioned operation, the space between the head 12*a* and the platen roller 30 becomes large to allow the paper P to advances thereinto, and at this time, the head 12*a* pressurizes the paper P under a given pressure by means of the springs P to apply heat to the paper P, so that given colors are expressed according to the heating temperature or heating time applied from the head 12*a*, thereby printing images or texts.

On the other hand, a print quality of the photo printer becomes high when the head 12*a* and the paper P come into maximum line contact with each other. This is because the head 12*a* locally transfers the heat controlled by the PCB 13 to the corresponding portion of the paper P.

In the conventional photo printer, however, the hinge shafts 11 are located in front of the platen roller 30, and the springs S are at the back of the platen roller 30, so that when the paper P moves forwardly, the space between the head 12*a* and the platen roller 30 becomes large through the swing operation of the lower casing 20, but such swing operation is not easily carried out. Especially, the hinge shafts 11 are located in front of the platen roller 30, thereby causing the space between the head 12*a* and the platen roller 30 at the advancing side of the paper P to become large, but rather, the space between the head 12*a* and the platen roller 30 at the discharging side of the paper P becomes small.

Accordingly, the space between the head 12*a* and the platen roller 30 at the discharging side of the paper P becomes small so that the platen roller 30 becomes compressed and deformed in shape at the portion coming into contact with the paper P, thereby undesirably causing the paper P and the platen roller 30 not to come into line contact with each other, but to come into surface contact with each other. As a result, the heat of the head 12*a* is not transferred locally to the corresponding portion of the paper P, but transferred over the adjacent portion (surface contact portion L) to the corresponding portion of the paper P, thereby lowering a print quality of the photo printer (See (b) of FIG. 3).

On the other hand, a frictional force between the pickup roller 40 and the paper P is not large so that the paper P is not gently fed.

Further, only a sheet of paper has to be fed forwardly by means of the pickup roller 40, but in some cases, undesirably, two or more sheets of paper may be often fed due to static electricity occurring on the paper sheets.

SUMMARY OF THE INVENTION

Accordingly, the present invention has been made in view of the above-mentioned problems occurring in the prior art, and it is an object of the present invention to provide a photo printer that is configured to allow heat applied from a head to be transferred to a local portion of paper, thereby improving a print quality thereof.

To accomplish the above-mentioned object, according to the present invention, there is provided a photo printer for applying given heat to paper responding to the given heat to express given colors so as to print images or texts, the photo printer including: a base adapted to accommodate the paper therein; a pickup roller protruding from the bottom of the base to feed the paper accommodated in the base forwardly; a platen roller disposed in front of the base to discharge the paper fed by the pickup roller forwardly; a head located above the platen roller to apply the given heat to the paper; a swing bracket having a mounting portion formed at the front side thereof in such a manner as to be coupled to the head and coupling portions formed at the rear side thereof in such a manner as to be rotatably coupled to the base to allow the head to swing; and pressurizing means adapted to pressurize the head downwardly to allow the head to come into close contact with the paper advancing into the space between the head and the platen roller.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Now, an explanation on a photo printer according to the present invention will be given with reference to the attached drawings.

Figure 4:
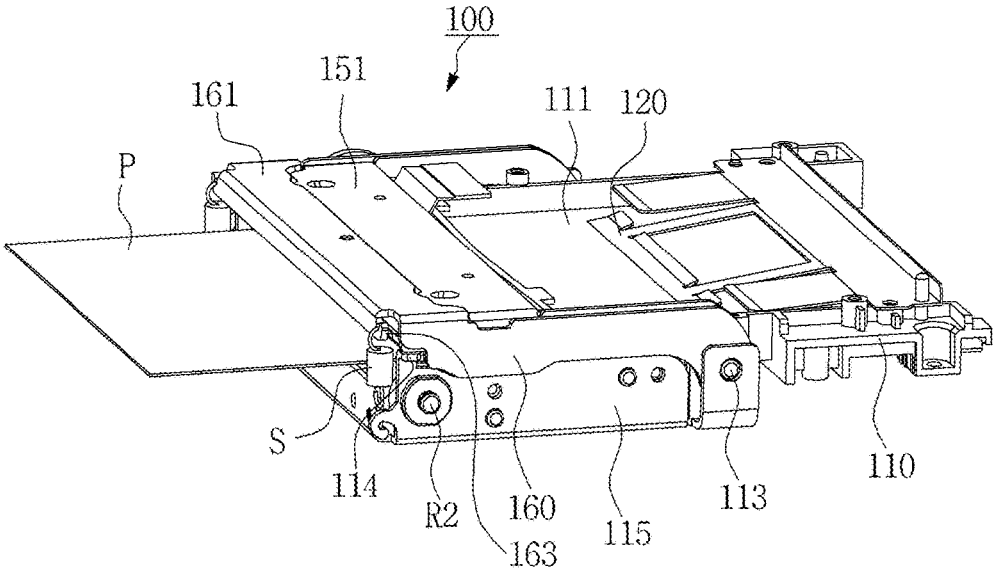
FIGS. 4 to 6 are perspective and sectional views showing a photo printer according to the present invention.
Figure 5:
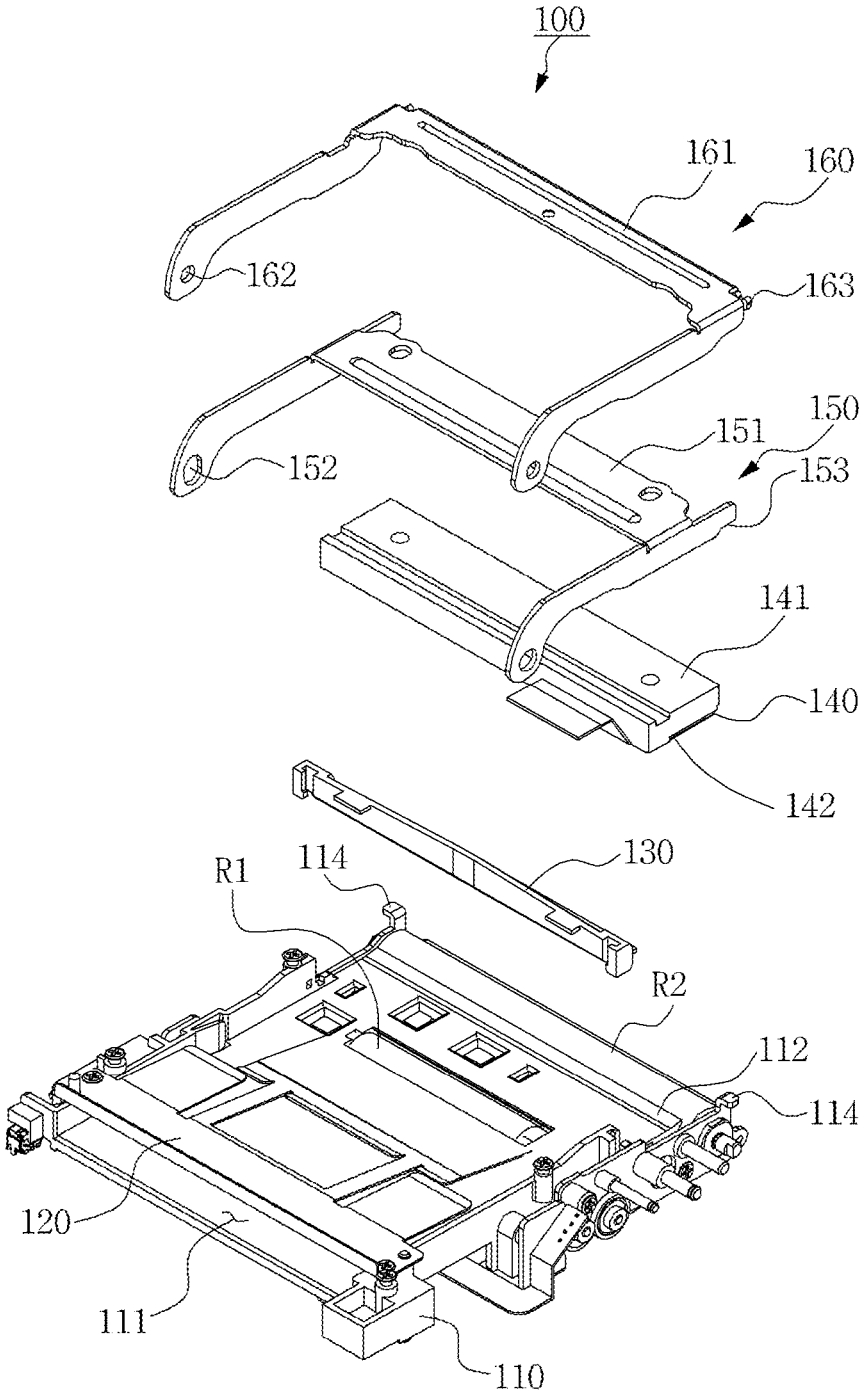
Figure 6:
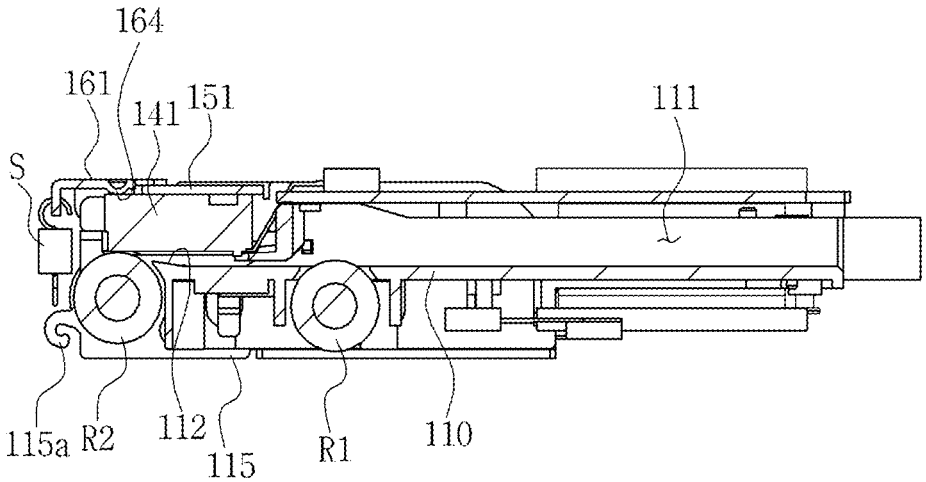
Figure 9:
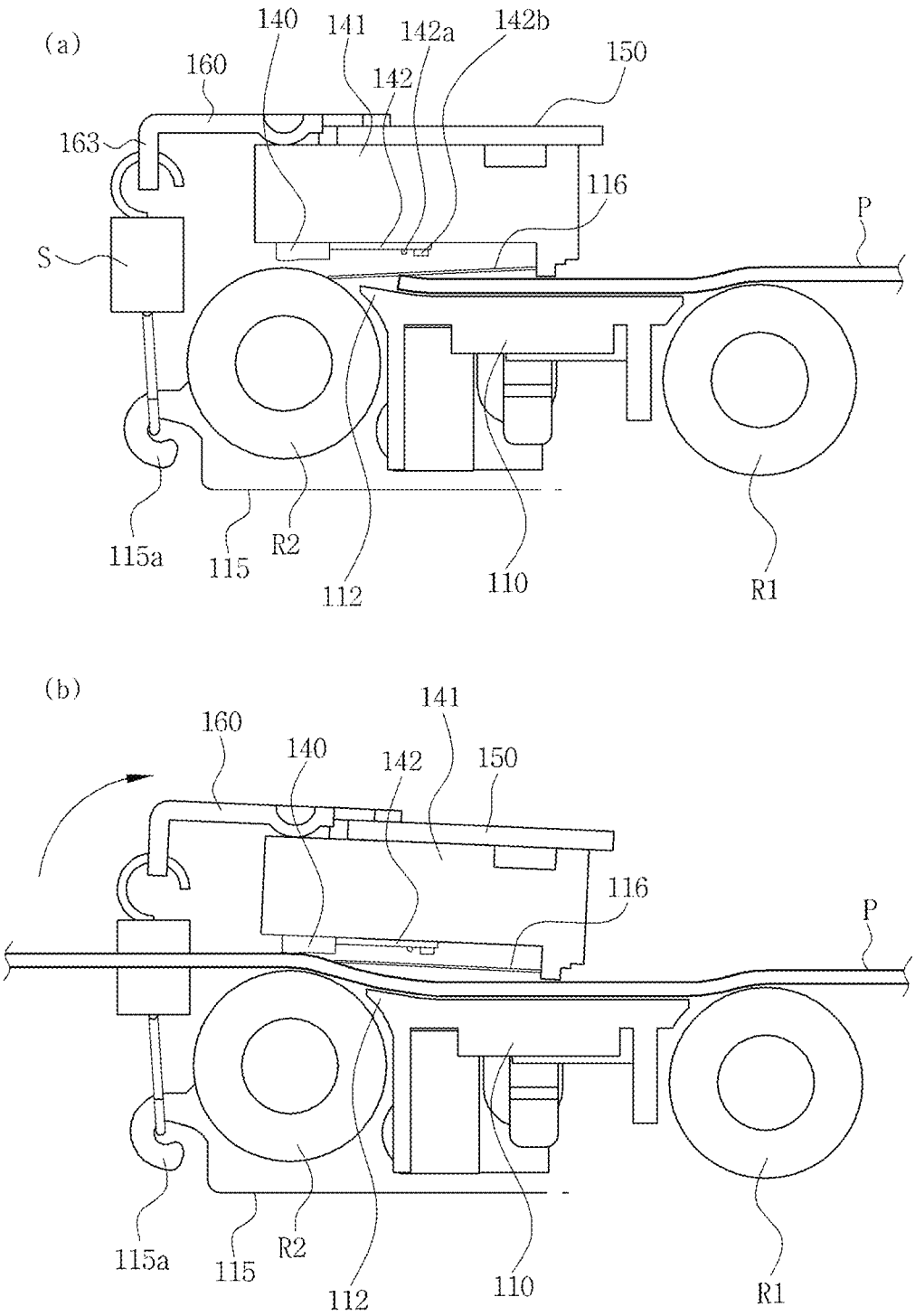

Referring to FIGS. 4 to 6, a photo printer 100 according to the present invention includes a base 110, a pickup roller R1, a platen roller R2, a head 140 (See (a) and (b) of FIG. 9), a swing bracket 150, and pressurizing means 160.

According to the present invention, the base 110 has a paper feeder 111 disposed thereon to have paper sheets stackedly accumulated therein and a lower base 115 extended forwardly from the lower portion thereof. In this case, the base 110 and the lower base 115 are separately provided and coupled to each other, which allows them to be easily manufactured, but of course, the base 110 and the lower base 115 may be formed unitarily with each other.

The pickup roller R1 protrudes from the bottom of the paper feeder 111 of the base 110 to feed the lowest paper of the stacked paper sheets forwardly.

On the other hand, a paper pressurizing member 120 is provided to elastically pressurize the paper sheets stacked on the paper feeder 111 downwardly, and the paper pressurizing member 120 is coupled to the top surfaces of the side walls of the base 110 in such a manner as to be inclined downwardly toward the pickup roller R1 to downwardly pressurize the stacked paper sheets. If the stacked paper sheets are pressurized, a frictional force between the paper sheets and the pickup roller R1 becomes large, so that when the pickup roller R1 rotates, the lowest paper among the stacked paper sheets is gently fed forwardly.

The platen roller R2 serves to discharge the paper fed by the pickup roller R1 forwardly and has a rotary shaft coupled to the lower base 115.

The head 140 is located above the platen roller R2, and the head 140 applies given heat to the paper to express the colors corresponding to the given heat, thereby printing images or texts. The head 140 has a ceramic plate (not shown) disposed on top thereof and a heating plate 141 made of a metal material disposed on the ceramic plate (See (a) and (b) of FIG. 9).

Further, the head 140 has a PCB 142 adapted to control a heating temperature or time thereof. That is, the head 140 and the PCB 142 are attached to the underside of the heating plate 141.

The paper advances into the space between the head 140 and the platen roller R2, and according to the present invention, particularly, the head 140 is not fixed to the base 110, but rotatably mounted. In more detail, the head 140 is coupled to a mounting portion 151 formed at the front side of the swing bracket 150.

Figure 2:
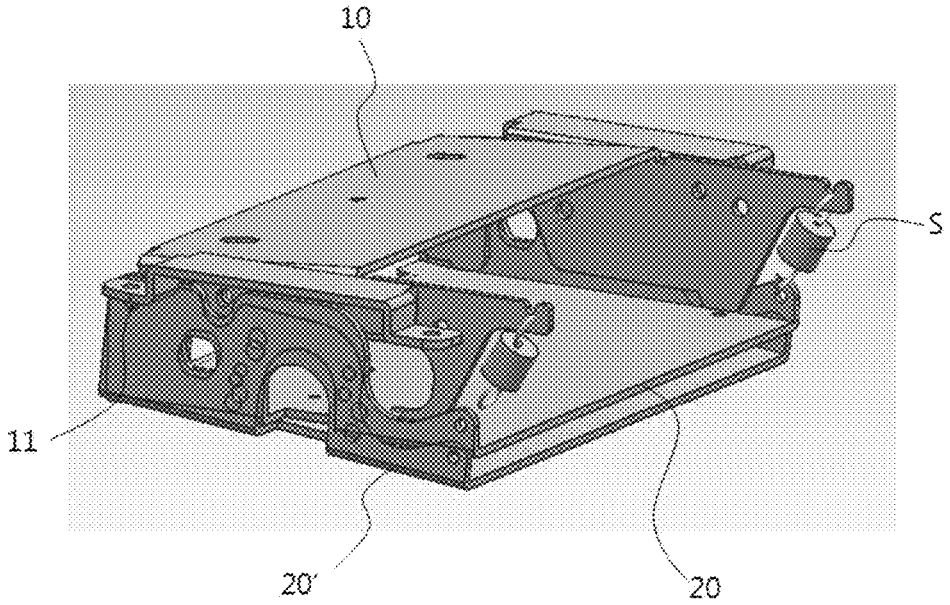
FIG. 2 Prior Art
FIG. 2 is a perspective view showing a hinge-coupling structure between an upper casing and a lower casing of the conventional photo printer of FIG. 1.

So as to enlarge the space between the head 140 and the platen roller R2 when the paper advances into the space between the head 140 and the platen roller R2, further, the swing bracket 150 has hinge holes 152 formed as coupled portions on the rear side thereof in such a manner as to be coupled to rotary shafts 113 located on the side walls of the base 110. Unlike the conventional photo printer as shown in FIG. 2, according to the present invention, the rotary shafts 113 for swinging the swing bracket 150 are located behind the rotary shaft of the platen roller R2. Such configuration enables the head 140 to easily swing in consideration of the advancing direction of the paper when the paper advances into the space between the head 140 and the platen roller R2. When the paper advances into the space between the head 140 and the platen roller R2, accordingly, the spaces between the head 140 and the platen roller R2 at the advancing side of the paper as well as at the discharging side thereof become large to minimize the compression of the platen roller R2 made of a soft material. As the paper further advances into the space, in more detail, the head 140 swings at a larger angle, so that the compression of the soft platen roller R2 can be minimized.

Also, the head 140 comes into close contact with the paper to transfer heat to the paper, and so as to allow the head 140 to come into close contact with the paper, the pressurizing means 160 pressurizes the head 140 downwardly. The pressurizing means 160 has a pressurizing portion 161 adapted to pressurize top of the head 140 and hinge holes 162 formed as coupling portions for rotating the pressurizing portion 161 coaxially with the rotary shafts 113 coupled to the swing bracket 150.

On the other hand, the head 140 is pressurized downwardly through the pressurizing means 160, but a given space between the platen roller R2 and the head 140 should be maintained so as to allow the paper to advances into the given space therebetween, To do this, the lower base 115 has stoppers 114 protruding from both side top portions of the front end thereof, and the swing bracket 150 has locking projections 153 formed protrudingly from the mounting portion 151 on which the head 150 is mounted in such a manner as to be locked onto the stoppers 114 to prevent the swing bracket 150 from moving downwardly anymore.

Figure 7:
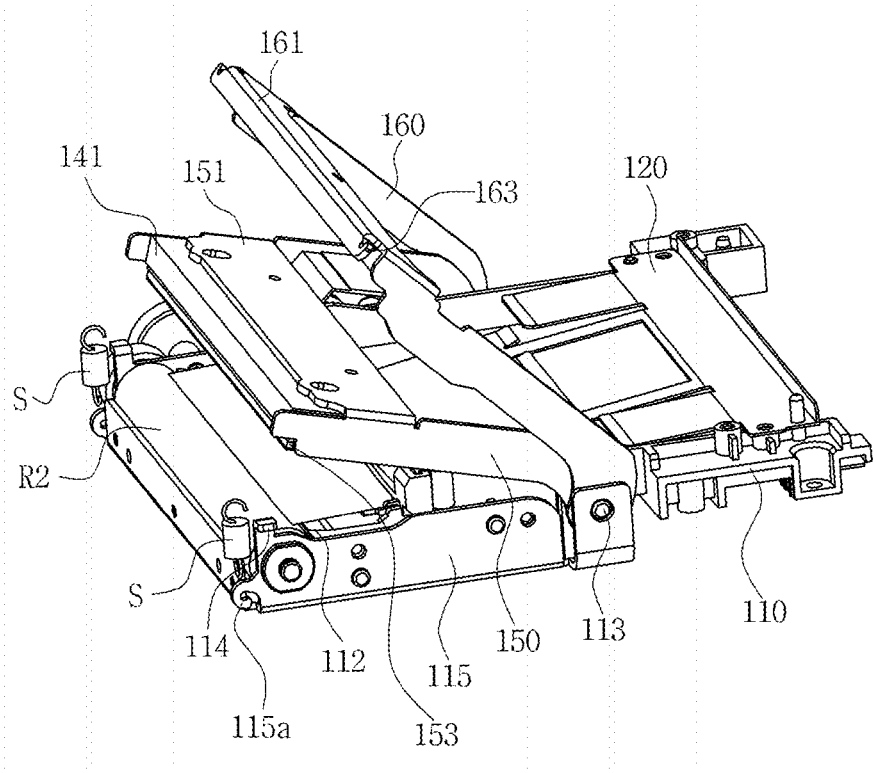
FIGS. 7 to 9 are perspective and sectional views showing the swing operations of the head of the photo printer according to the present invention.
Figure 8:
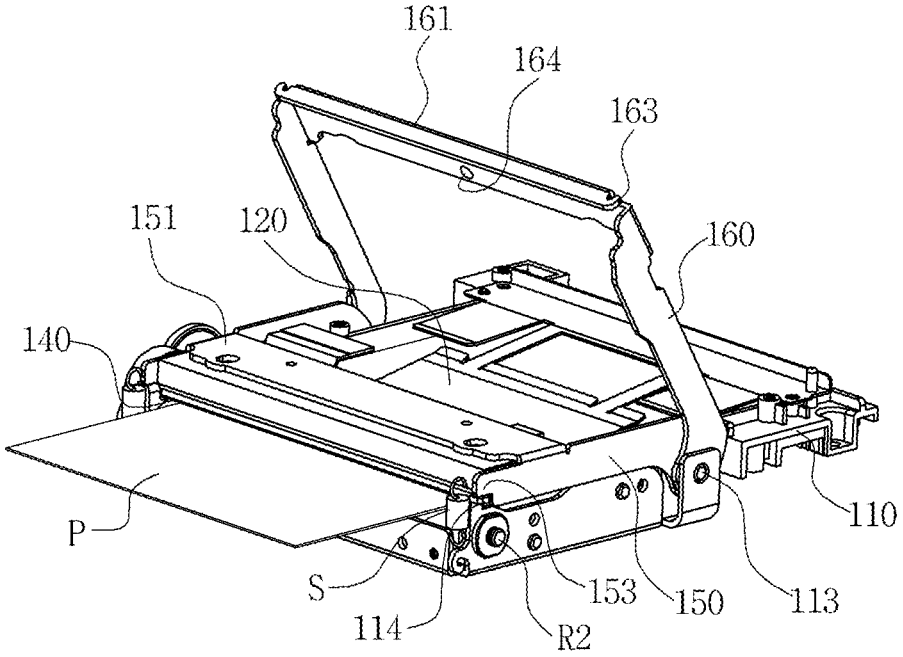

According to the present invention, as shown in FIGS. 7 and 8, the swing bracket 150 and the pressurizing means 160 are swingably disposed around the rotary shafts 113 disposed on both side walls of the base 110.

Further, elastic members S are provided to elastically pull the pressurizing portion 161 of the pressurizing means 160 downwardly. In this case, one side of each elastic members S is connected to a connector 163 formed on the pressuring portion 161 and the other side thereof to a connector 115*a* formed on the front end of the lower base 115.

Accordingly, the head 140 is swingably disposed above the platen roller R2 and is elastically pressurized toward the platen roller R2 by means of the elastic members S.

On the other hand, the pressurizing portion 161 has a pressurizing protrusion 164 formed on the underside thereof. Accordingly, the pressurizing portion 161 and the heating plate 141 come into point contact with each other by means of the pressurizing protrusion 161, and in this state, the heating plate 141 is pressurized downwardly by means of the pressurizing portion 161. In this case, the head 140 is coupled to the underside of the heating plate 141, so that the head 140 is elastically pressurized toward the platen roller R2 by means of the pressurizing portion 161.

If the pressurizing portion 161 and the heating plate 141 come into surface contact with each other, the head 140 may be not pressurized under a uniform pressure by means of the pressurizing portion 161. For example, if the elastic members S connected to both sides of the pressurizing portion 161 exert different elastic forces from each other, the pressurizing portion 161 becomes twisted so that the downward pressurizing force of the pressurizing portion 161 toward the head 140 is not applied uniformly to the entire area of the head 140. That is, the pressure on one side of the pressurizing portion 161 becomes large, and contrarily, the pressure on the other side thereof becomes small, so that the head 140 becomes twisted to undesirably cause the space between the platen roller R2 and the head 140 to become not formed constantly.

So as to solve the above-mentioned problems, according to the present invention, the pressurizing protrusion 161 is formed to allow the pressurizing portion 161 and the heating plate 141 to come into point contact with each other.

Now, an explanation on the configuration and operating state of the photo printer according to the present invention will be given with reference to (a) and (b) of FIG. 9.

Figure 3:
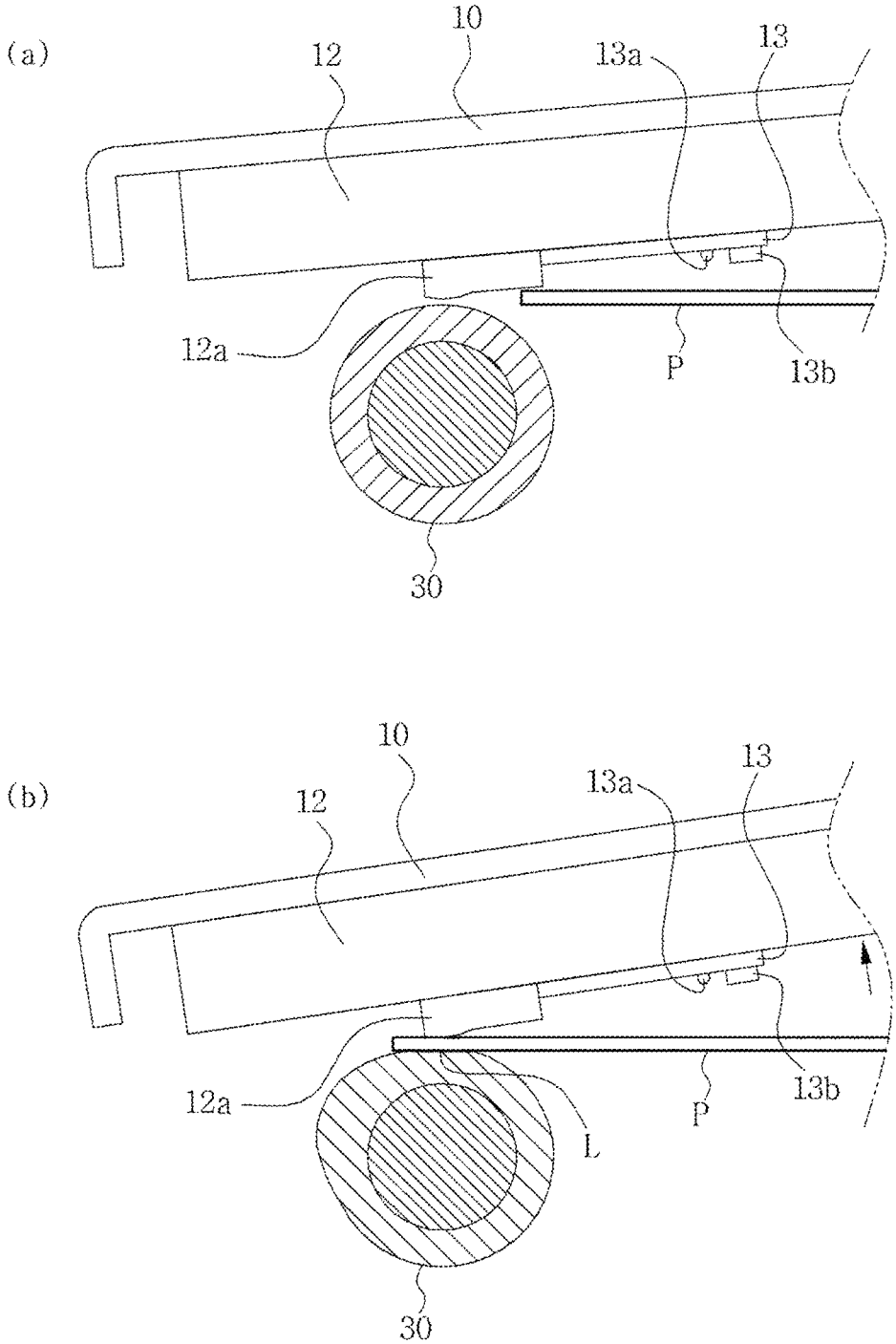
FIG. 3 Prior Art
FIG. 3 is sectional views showing the use states of the conventional photo printer.

The PCB 13 in the conventional photo printer (See (a) and (b) of FIG. 3) is inclinedly disposed, but according to the present invention, as shown in (a) of FIG. 9, the PCB 142 is disposed in parallel with the base 110. In addition, a guide sheet 116 is disposed to prevent the paper P from being locked onto a solder joint 142*a* and a device 142*b* of the PCB 142. So as to prevent the paper P from coming into contact with the PCB 142, that is, the guide sheet 116 is interposed between the PCB 142 and the base 110.

Figure 1:
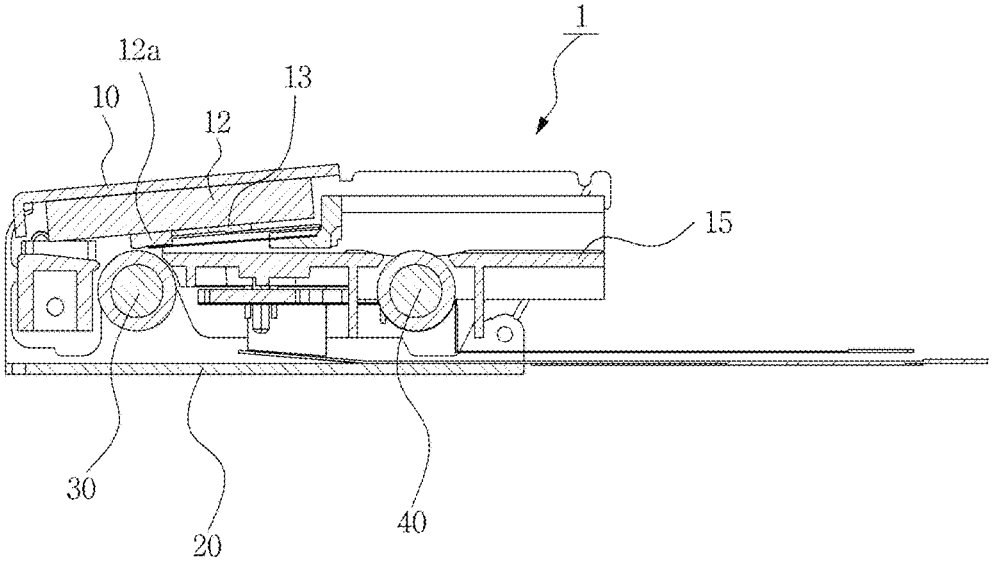
FIG. 1 Prior Art
FIG. 1 is a sectional view showing a conventional photo printer.

Further, the base 110 has a guide portion 112 inclined forwardly and upwardly from the front end thereof. Accordingly, the paper advancing by the pickup roller R1 does not move forwardly in a horizontal state, but moves forwardly and upwardly along the guide portion 112. However, it can be appreciated from the conventional photo printer as shown in FIG. 1 that the bottom of the base 15 corresponds to the top of the platen roller 30 to cause the paper to be fed horizontally.

Through the formation of the guide portion 112 on the front end of the base 110 in the photo printer according to the present invention, however, the bottom of the base 110 is lower than the top of the platen roller R2, so that the space between the paper P and the PCB 142 is sufficiently formed to prevent the paper P from being locked onto the device 142*b* of the PCB 142.

If the front end of the paper P upwardly advancing along the guide portion 112 enters the space between the head 140 and the platen roller R2, the swing bracket 150 coupled to the head 140 swings around the rotary shafts 113 to cause the head 140 to move upwardly. Accordingly, the space between the head 140 and the platen roller R2 becomes large, so that the paper P enters the space therebetween. As the space between the head 140 and the platen roller R2 becomes large through the advance of the paper P, further, the compression of the platen roller R2 is minimized.

However, the head 140 is elastically pressurized downwardly by means of the elastic members S, so that the head 140 comes into close contact with the paper P, while elastically pressurizing the paper P.

As the swing bracket 150 swings, on the other hand, the head 140 moves upwardly, so that even if the paper P enters, the excessive deformation of the platen roller R2 can be prevented. Accordingly, the head 140 maintains the state of the line contact with the paper P, not the state of the surface contact with the paper P, so that the heat applied from the head 140 is locally transferred to the corresponding portion of the paper P, thereby improving a print quality of the photo printer.

Particularly, the rotary shafts 113 for swinging the swing bracket 150 are disposed behind the rotary shaft of the platen roller R2, so that while the paper P is entering, the head 140 easily swings to allow the paper P and the platen roller R2 to come into a maximum line contact with each other, thereby improving a print quality of the photo printer.

Figure 10:
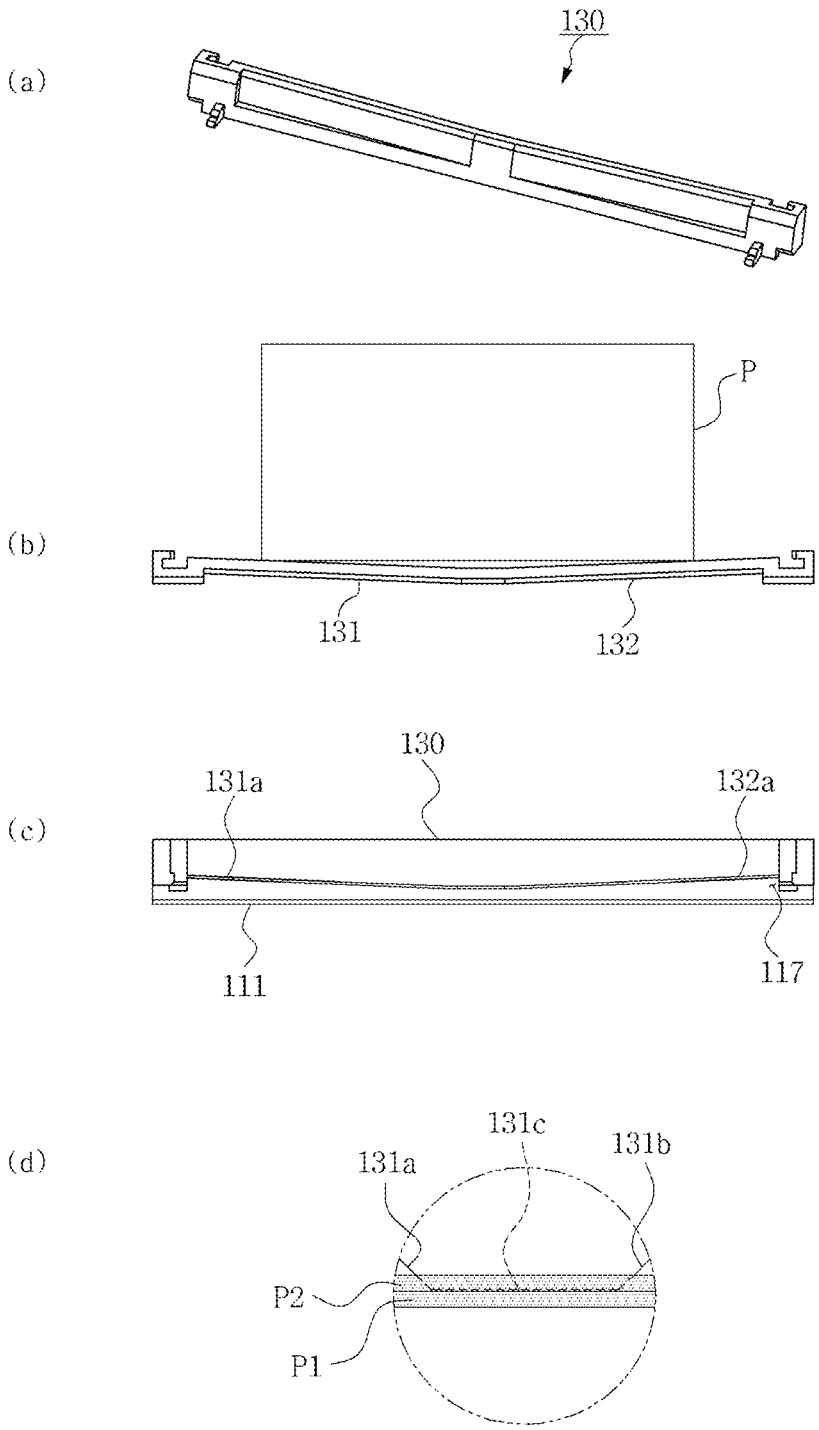
FIGS. 10 to 14 are detailed views showing the main parts of the photo printer according to the present invention.
Figure 11:
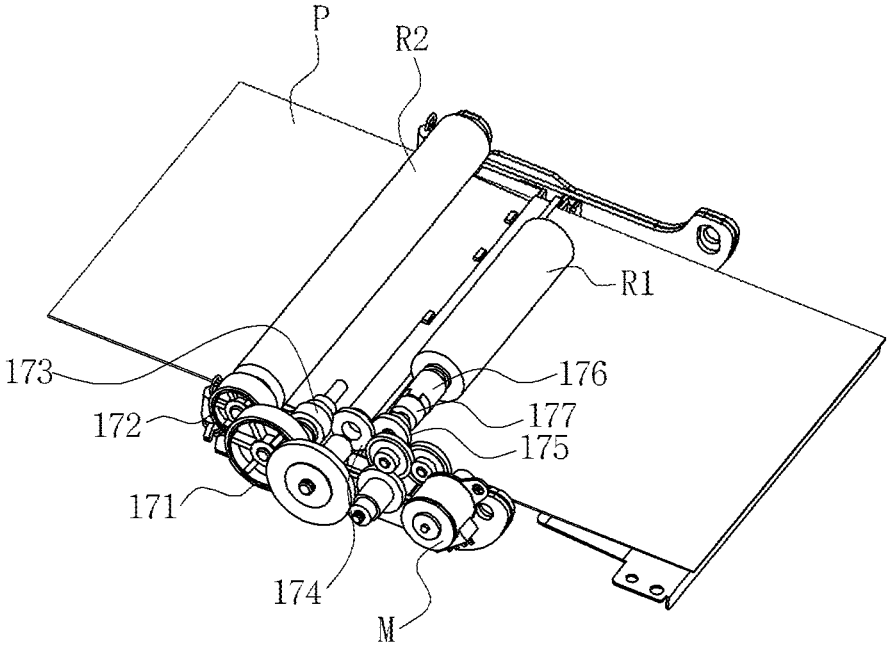
Figure 12:
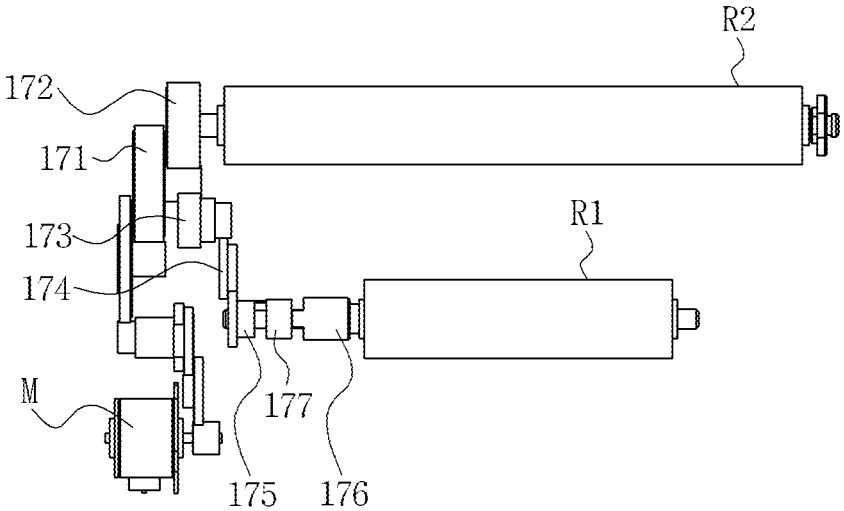
Figure 13:
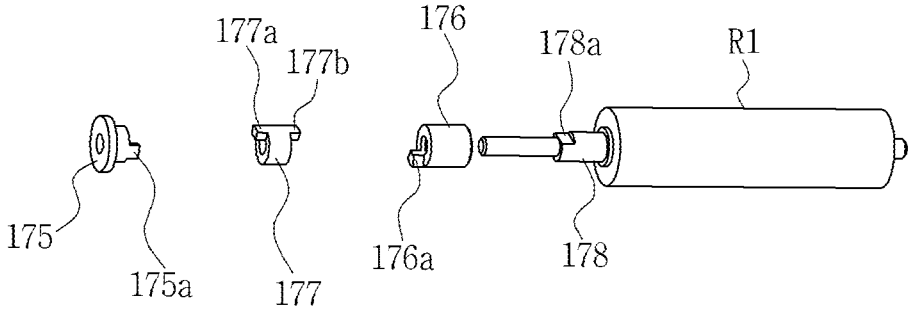
Figure 14:
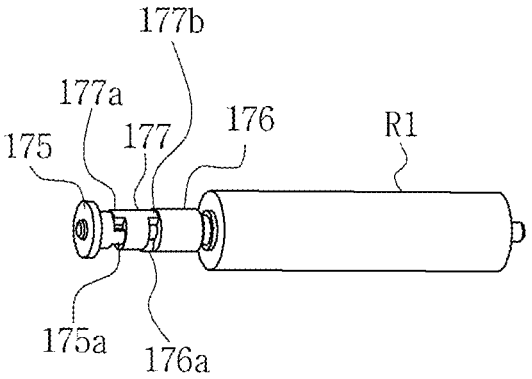

(a) to (d) of FIG. 10 show a double feed prevention member 130. In more detail, (a) of FIG. 10 is a perspective view of the double feed prevention member 130, (b) of FIG. 10 is a top view thereof, (c) of FIG. 10 is a front view thereof, and (d) FIG. 10 is an enlarged front view thereof when two sheets of paper enter.

As mentioned above, the lowest paper among the paper sheets stacked in the paper feeder 111 is fed forwardly.

In some cases, however, two or more sheets of paper may be fed due to static electricity while the lowest paper is being fed. In this case, printing is not normally carried out, and accordingly, the double feed prevention member 130 as shown in (a) of FIG. 10 is provided. The double feed prevention member 130 has a shape of a plate having a given length and disposed vertically and includes a slit 117 (See (c) of FIG. 10) formed in a space with the paper feeder 111 to pass only a sheet of paper therethrough.

Referring to (b) of FIG. 10, the double feed prevention member 130 has a wedge-shaped plane surface protruding forwardly therefrom toward the center thereof. That is, a first side wall 131 at the left side of the figure and a second side wall 132 at the right side of the figure are inclinedly formed. If two or more sheets of paper are at the same time fed, both ends of the upper paper of the two or more sheets of paper are locked onto both side walls 131 and 132 of the double feed prevention member 130, thereby preventing the upper paper from being fed forwardly.

Referring to (c) and (d) of FIG. 10, the double feed prevention member 130 is inclined downwardly from both sides of the lower end thereof toward the center thereof. That is, a first side 131*a* and a second side 132*a* of the underside of the double feed prevention member 130 are inclined and converged to the center thereof. As described in (b) of FIG. 10, if two or more sheets of paper are at the same time fed, both ends of the upper paper of the two or more sheets of paper are locked onto both side walls 131 and 132 of the double feed prevention member 130, so that the upper paper moves forwardly, while being isolated from the lowest paper, and accordingly, only the lowest paper can be passed under the underside of the center of the double feed prevention member 130.

Referring to FIGS. 11 to 14, the photo printer 100 according to the present invention includes a motor M adapted to drive the platen roller R2 and the pickup roller R1. That is, the platen roller R2 and the pickup roller R1 are at the same time driven by means of one motor M.

According to the present invention, that is, a gear assembly is provided to drive the platen roller R2 and the pickup roller R1 through one motor M, and in more detail, the gear assembly includes a transgear 171 engaged with the motor M, a first power transfer part for rotating the platen roller R2, and a second power transfer part for rotating the pickup roller R1.

Both sides of the transgear 171 are engaged with the first power transfer part and the second power transfer part.

The first power transfer part for rotating the platen roller R2 is engaged with the transgear 171 and has a first gear 172 coupled to the rotary shaft of the platen roller R2.

The second power transfer part for rotating the pickup roller R1 has a second gear 173 engaged with the transgear 171, a clutch gear 175 adapted to pass a rotary shaft 178 of the pickup roller R1 therethrough, and a connection gear 174 and a clutch 176 adapted to connect the second gear 173 and the clutch gear 175 with each other.

In this case, the rotating speed of the platen roller R2 is faster than that of the pickup roller R1.

The clutch gear 175 is connected to the transgear 171 and a first protrusion 175*a* formed on one side thereof.

Further, the clutch 176 passes the rotary shaft 178 of the pickup roller R1 therethrough in such a manner as to be fixed to the rotary shaft 178 and has a second protrusion 176*a* formed on one side thereof. The rotary shaft 178 of the pickup roller R1 has a stepped projection 178*a* formed thereon, and the inner peripheral surface of the clutch 176 is fixed to the rotary shaft 178 through the matching in shape with the stepped projection 178*a*.

Furthermore, at least one or more idle clutches 177 are disposed between the clutch gear 175 and the clutch 176.

The idle clutch 177 has a third protrusion 177*a* and a fourth protrusion 177*b* formed on both sides thereof. The third protrusion 177*a* is engaged with the first protrusion 175*a*, and the fourth protrusion 177*b* with the second protrusion 176*a*.

Under the above-mentioned configuration, the rotary force of the motor M is transferred to the transgear 171 to rotate the clutch gear 175.

If the clutch gear 175 rotates, moreover, the first protrusion 175*a* is engaged with the third protrusion 177*a* to rotate the idle clutch 177, and through the rotation of the idle clutch 177, the fourth protrusion 177*b* is engaged with the second protrusion 176*a* to rotate the clutch 176. Lastly, since the clutch 176 is fixed to the rotary shaft 178 of the pickup roller R1, the pickup roller R1 rotates.

On the other hand, the rotating speed of the platen roller R2 is faster than that of the pickup roller R1, and especially, if the front end of the paper P is locked onto the platen roller R2 while the paper P is being fed forwardly by the pickup roller R1, the pickup roller R1 is operated cooperatively with the platen roller R2 so that the pickup roller R1 rotates at the same speed as the platen roller R2.

In this case, that is, the slow rotary force transferred to the second power transfer part does not rotate the pickup roller R1 anymore, and the pickup roller R1 is operated cooperatively with the rotation of the platen roller R2.

In more detail, if the pickup roller R1 is operated cooperatively with the paper P and rotates at the same speed as the platen roller R2, the clutch 176 coupled to the rotary shaft 178 of the pickup roller 178 rotates at a faster speed than the idle clutch 177. That is, the second protrusion 176*a* rotates at a faster speed than the fourth protrusion 177*b*, so that the fourth protrusion 177*b* does not push and rotate the second protrusion 176*a* anymore.

If the rotation of the clutch 176 is faster by one rotation than that of the idle clutch 177 through the continuity of the state, contrarily, the second protrusion 176*a* pushes and rotates the fourth protrusion 177*b*. In this state, since the third protrusion 177*a* rotates before the first protrusion 175*a* rotates, the clutch gear 175 does not rotate the idle clutch 177 anymore. That is, the pickup roller R1 does not rotate by means of the clutch gear 175, but is operated cooperatively with the platen roller R2 and rotates at a faster speed.

If the length of the paper P is short to cause the cooperatively operating section of the pickup roller R1 with the platen roller R2 to be reduced, the idle clutch 177 is removed so that only the clutch gear 175 and the clutch 176 may be provided. Contrarily, if the length of the paper P is long to cause the cooperatively operating section of the pickup roller R1 with the platen roller R2 to be increased, two or more idle clutches 177 may be provided.

That is, there is no idle clutch 177 between the clutch gear 175 and the clutch 176 if the length of the paper P is short, and there are two or more idle clutches 177 therebetween if the length of the paper P is long, which depends upon the length of the paper P.

According to the present invention, therefore, sufficiently long paper P can be provided through the formation of the idle clutch 177.

In the conventional practice, on the other hand, the rotary force of the motor M is applied to the rotary shaft of the platen roller R2 by means of the first power transfer part and rotates the rotary shaft of the platen roller R2. Next, the rotary force at the opposite side to the rotary shaft of the platen roller R2 is reduced to rotate the pickup roller R1. That is, the first power transfer part for rotating the platen roller R2 and the second power transfer part for rotating the pickup roller R1 are disposed on the different sides of the base 110 from each other. In this case, a load is applied to the rotary shaft itself of the platen roller R2 to cause the platen roller R2 to become twisted. Accordingly, the paper does not move straight forwardly, but moves slantly forwardly. According to the present invention, however, the pickup roller R1 does not receive the rotary force of the platen roller R2, but directly receives the rotary force of the transgear 171, that is, the rotary force of the motor M so that it rotates. Accordingly, the platen roller R2 does not twist, so that the paper can move straight forwardly.

Further, the first power transfer part and the second power transfer part are disposed on the same side of the base 110 as each other, thereby making the photo printer simple in configuration. This is possible because the first power transfer part and the second power transfer part are connected commonly to the transgear 171.

As described above, the photo printer according to the present invention is configured wherein the head elastically swings above the platen roller so that when the paper advances into the space between the head and the platen roller, the space between the head and the platen roller becomes large to minimize the compression of the platen roller made of the soft material.

In addition, the photo printer according to the present invention is configured wherein the increment of the contact area between the paper and the platen roller is prevented so that the heat applied from the head is locally transferred to the corresponding portion of the paper, thereby improving a print quality thereof.

Particularly, the photo printer according to the present invention is configured wherein the rotary shafts for swinging the swing bracket are located behind the rotary shaft of the platen roller, so that the head easily swings as the paper enters, thereby minimizing the compression of the platen roller to allow the paper and the platen roller to come into maximum line contact with each other to improve a print quality thereof.

Further, the photo printer according to the present invention is configured wherein the pressurizing bracket comes into point contact with the top of the head (heating plate), and in this state, the head is pressurized under a uniform pressure over the entire area thereof, without being twisted, so that the space between the head and the platen roller can be constantly maintained.

Also, the photo printer according to the present invention is configured wherein the pickup roller does not receive the rotary force of the platen roller, but directly receives the rotary force of the motor, so that the loss of power is reduced and the pickup roller rotates at an accurate speed ratio.

Moreover, the photo printer according to the present invention is configured wherein the power transfer part for rotating the pickup roller and the power transfer part for rotating the platen roller are disposed on the same side of the base as each other, thereby making the photo printer simple in configuration and also allowing the photo printer to be reduced in volume.

Further, the photo printer according to the present invention is configured wherein two or more idle clutches are disposed on the power transfer part for rotating the pickup roller so that long paper can be used.

Furthermore, the photo printer according to the present invention is configured wherein the base is inclined forwardly and upwardly from the front end thereof, so that even if the PCB is mounted horizontally, the paper is not locked onto the device of the PCB.

In addition, the photo printer according to the present invention is configured wherein the guide sheet is interposed between the PCB and the base so that the paper is not locked onto the device of the PCB.

Moreover, the photo printer according to the present invention is configured wherein the paper pressurizing member is provided to elastically pressurize the paper sheets stacked on the paper feeder downwardly so that when the pickup roller rotates, the lowest paper among the stacked paper sheets is gently fed forwardly.

Also, the photo printer according to the present invention is configured wherein only a sheet of paper from the stacked paper sheets is fed forwardly by means of the pickup roller.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A photo printer for applying given heat to paper responding to the given heat to express colors so as to print images or texts, the photo printer comprising:

a base adapted to accommodate the paper therein;

a pickup roller protruding from the bottom of the base to feed the paper accommodated in the base forwardly;

a platen roller disposed in front of the pickup roller to discharge the paper fed by the pickup roller forwardly;

a head located above the platen roller to apply the given heat to the paper;

a swing bracket having a mounting portion formed at the front side thereof in such a manner as to be coupled to the head and coupling portions formed at the rear side thereof in such a manner as to be rotatably coupled to the base to allow the head to swing; and pressurizing means adapted to pressurize the head downwardly to allow the head to come into close contact with the paper advancing into the space between the head and the platen roller, wherein the pressurizing means has coupling portions rotatably coupled to the base.

2. The photo printer according to claim 1, wherein the pressurizing means comprises:

a pressurizing bracket having a pressurizing portion formed at the front side thereof in such a manner as to be located above the head and the coupling portions are formed at the rear side thereof in such a manner as to be rotatably coupled to the base; and elastic members adapted to pull the pressurizing portion downwardly.

3. The photo printer according to claim 2, wherein the pressurizing portion has a pressurizing protrusion formed protrudingly from the underside thereof.

4. The photo printer according to claim 1, wherein between the head and the platen roller are formed stoppers adapted to prevent the head from moving downwardly under a given position so that the space between the head and the platen roller is formed.

5. The photo printer according to claim 1, wherein the head comprises a PCB disposed in parallel with the base and adapted to control heating temperature or time thereof, and the base comprises a guide portion inclined forwardly and upwardly from the front end thereof.

6. The photo printer according to claim 5, wherein between the PCB and the base is disposed a guide sheet adapted to prevent the paper from coming into contact with the PCB.

* * * * *